United States Patent [19]

Bérczes

[11] Patent Number: 5,007,593

[45] Date of Patent: Apr. 16, 1991

[54] APPARATUS FOR EXPOSING THE REINFORCING BARS OF REINFORCED CONCRETE PILLARS

[75] Inventor: Zsolt Bérczes, Küsnacht, Switzerland

[73] Assignee: Diaber AG, Kuesnacht, Switzerland

[21] Appl. No.: 550,792

[22] Filed: Jul. 10, 1990

Related U.S. Application Data

[63] Continuation of Ser. No. 336,102, Apr. 11, 1989, abandoned.

[30] Foreign Application Priority Data

Apr. 27, 1988 [CH] Switzerland ..... 1580/88
Nov. 15, 1988 [CH] Switzerland ..... 4235/88

[51] Int. Cl.[5] ..... B02C 1/10
[52] U.S. Cl. ..... 241/264; 125/23 C
[58] Field of Search ..... 241/101.7, 264; 125/23 R, 23 C

[56] References Cited

U.S. PATENT DOCUMENTS 3,056,267 10/1962 McRee .
3,392,719 7/1968 Clantor et al. .
4,124,015 11/1978 Tsaksson .
4,180,047 12/1979 Bertelson .
4,512,524 4/1985 Shigemizu ..... 241/101.7

FOREIGN PATENT DOCUMENTS 51837 5/1982 European Pat. Off. .
2713613 10/1977 Fed. Rep. of Germany .
177930 12/1980 Netherlands .
1290374 9/1972 United Kingdom .

OTHER PUBLICATIONS

Hydro-Pile Breaker PC 1000, Mattec.
Hydro-Pile Breaker PC 1000, Persluchtcentrale Ned. b.v.
Diaber Pile-Cracker, Diaber AG.

*Primary Examiner*—Joseph M. Gorski
*Attorney, Agent, or Firm*—Laubscher Presta & Laubscher

[57] ABSTRACT

The crushing tools are designed as rocker-like chisels having cutting edges. These chisels are pivotably supported at a frame such to pivot around a horizontal axis. These chisel-like crushing tools are operated by a piston-cylinder unit which extends almost vertically and is pivotably mounted to the box-shaped frame. Accordingly, the apparatus can be designed with a small width. Furthermore, the rocker-like design of the crushing tools allows due to the various lengths of the lever arms an increase of the forces without necessitating an exchanging of the piston-cylinder units. Furthermore, an adjusting of the apparatus to pillars of varying thickness is made merely by an exchanging of the crushing tools having dimensions of cutting edges which are selected in accordance with the prevailing distances between the reinforcing bars.

6 Claims, 3 Drawing Sheets

APPARATUS FOR EXPOSING THE REINFORCING BARS OF REINFORCED CONCRETE PILLARS

This application is a continuation of application Ser. No. 07/336,102, filed Apr. 11, 1989 and now abandoned.

BACKGROUND OF THE INVENTION

1. FIELD OF THE INVENTION

The present invention relates to an apparatus for exposing the reinforcing bars of pillars made of reinforced concrete, which apparatus includes a supporting structure in the form of a frame of a box-type design having a central through passage for receipt of a pillar being handled and having a plurality of crushing tools located at the area of said central through passage and driven each by a piston-cylinder unit, which crushing tools are distributed along the entire circumference of said central through passage, and including a means for selectively feeding a pressurized fluid to each piston-cylinder unit.

2. DESCRIPTION OF THE PRIOR ART

The piston-cylinder units of a known apparatus for exposing the reinforcing bars of pillars made of reinforced concrete are arranged at a lying condition, i.e. in the working position of this known apparatus, these piston-cylinder units extend horizontally. Every such unit is thereby provided with a piston having a penetrating tip. A pressurized fluid is made to act upon the piston, thereby causing it to penetrate into a respective concrete pillar in order to break the concrete and to expose the reinforcing bars which is the object of such procedure. Correspondingly, the respective piston-cylinder units must be arranged or distributed such that the mentioned tips penetrate into a pillar to be handled at areas between the respective reinforcing bars, thereby to avoid damaging these bars. Because the distance between reinforcing bars depends individually on the cross-sectional dimensions of a concrete pillar, the respective distance between two tips of the pistons and correspondingly between the piston-cylinder units must be selected for each installation. This situation has now requires that a user must posess a relatively larger number of different such apparatuses which obviously renders the storing thereof rather expensive and thus causes high operating costs. Because the distances between reinforcing bars vary in accordance with the prevailing thickness of the concrete pillars as explained above, it is not possible to work on concrete pillars having rrther small dimensions by the application of as given apparatus which is actually designed for a larger pillar thickness because it is possible to move or adjust, respectively, the complete piston-cylinder unit sideways. Furthermore, the horizontally arranged design of the pistons such as explained above leads to such space requirements that it is not possible to operate with the known apparatus at concrete pillars having a small mutual spacing distance.

Due to mentioned horizontal arrangement of the piston-cylinder units, it also has not been possible to work on a concrete pillar at a level down to the respective ground level such that it was necessary either to dig further into the ground in order to expose the corresponding section of the concrete pillar or then to break the lowermost areas of the pillars off by a manual operating (for example, by means of a compressed air hammer).

In order to keep the lateral dimensions of the known apparatuses as small as possible it was absolutely necessary to operate with small piston-cylinder units such that the force exertable by these small units onto the respective pillars has been rather limited. Furthermore, the circuit of the pressurized fluid of these known apparatuses has been such that the pistons have been extended independently of each other such that it was not absolutely certain that the devices would center themselves around a concrete pillar such that the points, at which mentioned tips of the pistons penetrated into the pillars were not always located between the respective reinforcing bars which again has led to the danger of a damaging of these reinforcing bars.

SUMMARY OF THE INVENTION

It is, therefore, a general object of the present invention to provide an apparatus for exposing the reinforcing bars of pillars made of reinforced concrete which is operable by expose the reinforcing bars down to the ground level of the respective pillars and which allows a self-centering of the apparatus around such pillar.

A further object of the invention is to provide such an apparatus, in which each crushing tool is designed as a rocker-like arranged chisel having at least one cutting edge, which chisel is pivotably mounted to a piston-cylinder unit at its end located oppositely of the at least one cutting edge and is pivotably supported at the frame at a location between the pivotal point of the chisel at the piston-cylinder unit and the cutting edge such to be pivotable around a pivot axis extending at least approximately normal relative to the longitudinal center axis of the frame.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
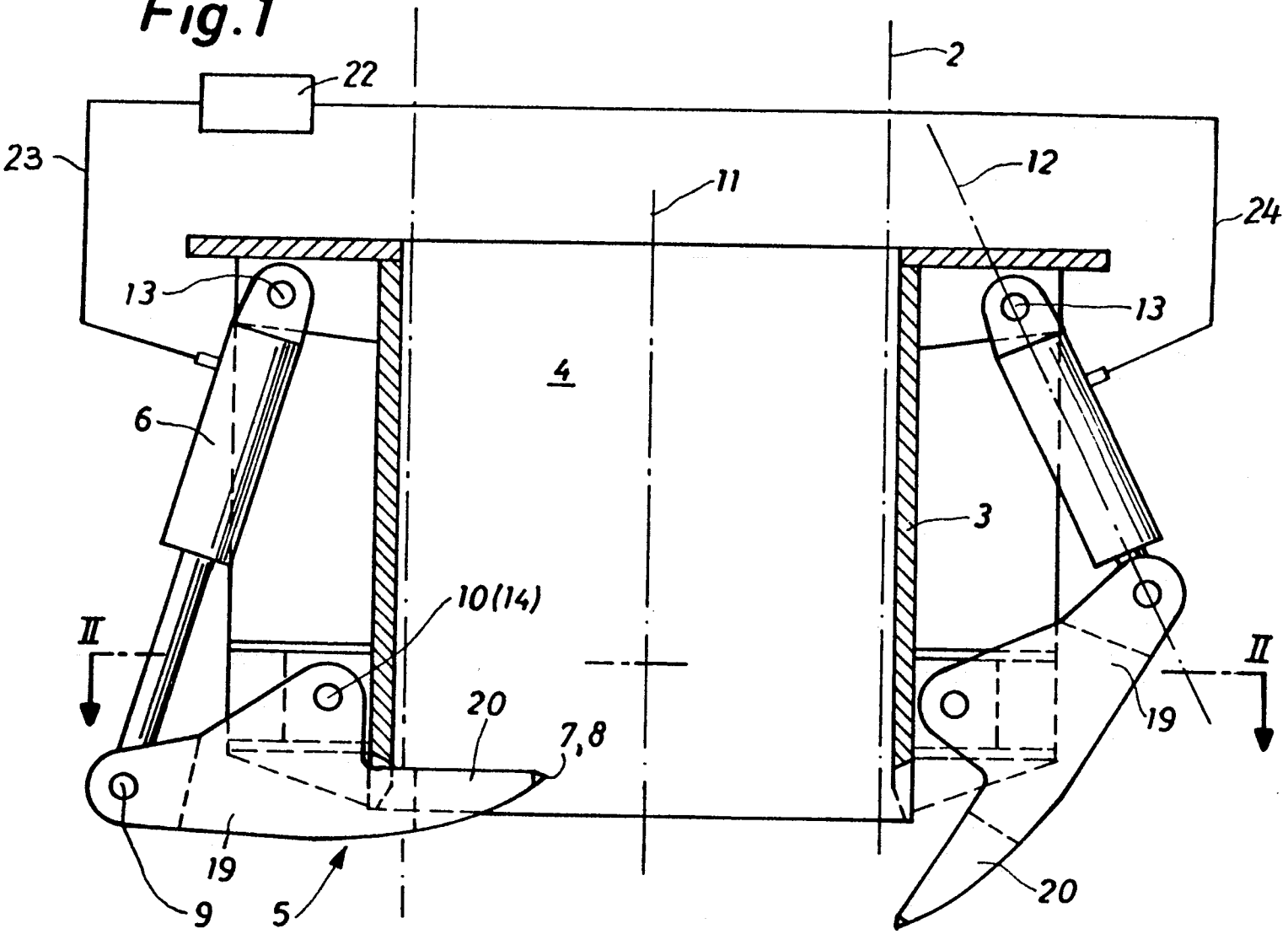
FIG. 1 illustrates schematically a view of a vertical section through an embodiment of the inventive apparatus for exposing the reinforcing bars of pillars made of reinforced concrete.

Reference numeral 3 appearing in FIG. 1 denotes a box-shaped frame, which is, for instance, a welded steel structure. The longitudinal center line of this frame 3 is denoted by the reference numeral 11. The frame 3 comprises a central through passage 4 for receipt of a concrete pillar 2 to be worked, which is designed in FIG. 1 with broken lines and whereby a pillar with the largest possible thickness is shown by these lines, which pillar may have also a smaller cross section such as illustrated as example in FIG. 2. The frame 3 has a rectangular through passage 4 such as specifically clearly visible in FIG. 2. At every side of this rectangular shape a piston-cylinder unit 6 is located, such as illustrated in FIG. 1. The right hand side in FIG. 1 illustrates the rest or initial, respectively, position of this unit and the left hand side of FIG. 1 shows this unit 6 in its final operating position. The piston-cylinder unit 6 is pivotably mounted at its end 9 to a crushing tool or chisel 5. This crushing tool 5 is designed as double-arm, rocker-like chisel and includes two cutting edges 7, 8 (see FIG. 2). This chisel 5 is connected with the frame by a pivot shaft 14 at a point between its two opposite ends. The pivot shaft 14 of this rocker-shaped crushing tool 5 extends at the position illustrated with the reference numeral 10 extends at least approximately normal relative to the longitudinal center axis 11 of the vertical plane which contains the frame 3 and which bisects the pivot axis. The crushing tool 5 includes accordingly two lever arms 19 and 20 relative to the position 10, i.e. relative to mentioned pivot shaft 14. The lever arm 19 is longer than the lever arm 20. The cutting edges 7, 8 of the crushing tool 5, i.e. of the chisel 5, extend at least approximately parallel to the pivot axis 14 of the chisel 5. At its upper end the unit 6 is pivotably mounted at the frame 3 at a location identified by the reference numeral 13. This location 13 is located higher than the pivot axis 14. In sharp contrast to all known apparatuses this piston-cylinder unit 6 is now oriented such that its longitudinal center axis 12 extends obliquely relative to the longitudinal center axis 11 of the frame 3 and no longer normal thereto as has been hitherto the case. This leads to a considerable saving on the space in a horizontal direction and, furthermore, each piston-cylinder unit 6 can be designed with such large dimensions that it is indeed in a position to apply the necessary high pressure force because practically no limits exist regarding the structural height of the frame 3.

Figure 2:
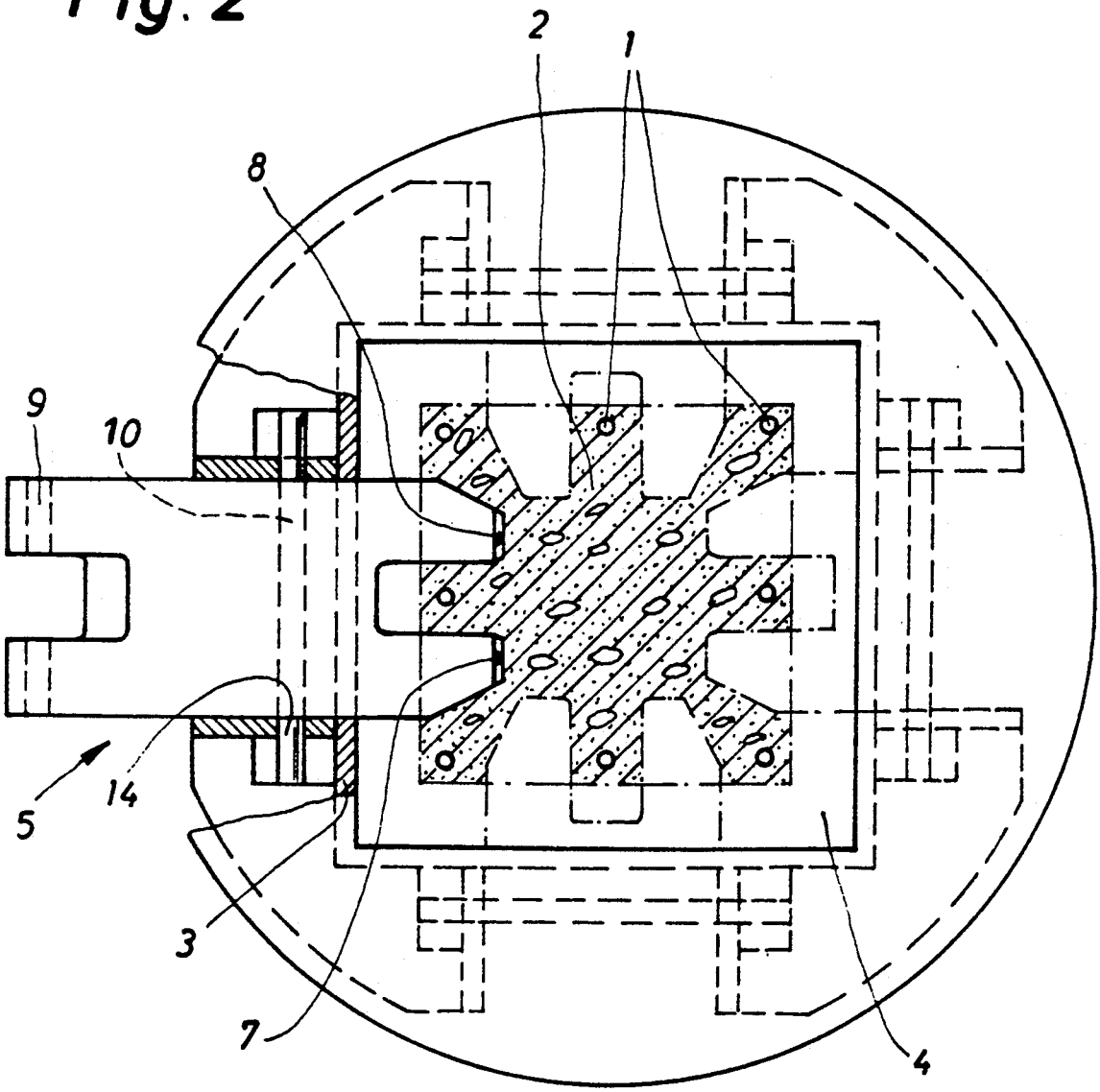
FIG. 2 illustrates on a schematic basis a section taken along line II—II of FIG. 1, in which figure certain parts have been omitted for sake of clarity.

FIG. 2 illustrates that each chisel 5 is of a forked design and comprises two cutting edges 7, 8. This design allows a safe penetrating into the concrete without destroying or damaging, respectively, its reinforcing iron bars 1.

The feeding of the hydraulic fluid to the four piston-cylinder units 6 via corresponding feed lines, of which two are illustrated in FIG. 1 and denoted by the reference numerals 23 and 24 includes a fluid mass flow control means of a conventional design, which guarantees that in every instance the same amount of hydraulic fluid is fed to all respective piston-cylinder means 6. The result thereof is that when the hydraulic fluid is fed into the four piston-cylinder means 6 the stroke of all four pistons thereof remains the same such that the apparatus is centered and remains centered around the respective pillar 2 being worked on. Should namely mentioned stroke not be the same for all units 6, it would be possible that the crushing tool 5 located at the left hand side of FIG. 2 makes prior to penetration into the concrete a larger stroke than the crushing tool located oppositely thereof, i.e. at the right hand side of FIG. 2. This would now obviously lead to a shifting of the frame 3 relative to the pillar 2 towards the left according to the illustration of FIG. 2 such that the cutting edges 7, 8 which are located seen in FIG. 2 at the top and at the bottom would not penetrate into the concrete pillar at the locations shown in broken lines and would penetrate in contrast thereto shifted somewhat to the left such that quite obviously a damaging of the reinforcing bars 1 would be caused.

It is accordingly no longer necessary to be provided with a plurality of such apparatuses of various sizes and to choose from such plurality of apparatuses the one which corresponds regarding the dimensions to the respective reinforced concrete pillar to be operated at. A single, possibly necessary adjusting may consist of an exchanging of the respective crushing tools 5 (but by keeping the piston-cylinder units) such to make merely at the area of the cutting edges 7, 8 the necessary adjusting to the distances between respective reinforcing bars 1.

The above description of this embodiment leads to the recognition of a plurality of advantages thereof. Because the piston-cylinder units 6 do no longer extend in a horizontal plane but rather obliquely upwards, a very narrow design is arrived at such that it is possible to work at pillars which are located relatively close to each other. The force of the units 6 acting almost in a vertical direction is transferred by the crushing tool 5 designed as double-armed lever in correspondence with the lever ratio of the two lever arms 19 and 20 such to act with an increased value onto the concrete pillar 2. The apparatus includes four crushing tools 5 located around the central through passage 4 of the frame 3 which allows an impeccable centering of the apparatus relative to the pillar 2 being worked. The crushing tool 5 is designed as fork-shaped chisel and includes accordingly two cutting edges 7, 8, which allows the chisel to penetrate deeply into the concrete without damaging the reinforcement 1. The width of the crushing tool 5, i.e.,of the cutting edges 7 and 8, can thereby be chosen completely independently of the size of the piston-cylinder unit 6 such that a respective adjusting in accordance with prevailing distances between reinforcing bars 1 can be arrived at without any further ado. The controller 22 controlling the flow of the hydraulic fluid guarantees that all four piston-cylinder units 6 and accordingly all four crushing tools 5 make one and the same stroke such that an automatic centering and no lateral shifting of the apparatus relative to the pillar 2 is arrived at. Finally, such as clearly can be seen in the right hand side of FIG. 1 the cutting edges 7, 8 when applied at a concrete pillar 2 form the lowermost part of the complete apparatus such that it is not necessary to dig further into a prevailing ground and also not necessary to use pressurized air hammers in order to work the concrete pillar 2 down to the ground level in order to properly expose the reinforcing irons.

The described apparatus allows a separation of thick disk-shaped sections of reinforced concrete pillars. There are, however, limits regarding the height of the disk-shaped parts which can be separated from a given pillar because such disk separated from a prevailing pillar must still be pulled upwardly over and away from the reinforcing bars 1. If the force applied is too large, it would be possible to tear these reinforcing bars off. In order to avoid such it is desirable to break or crush, respectively, the separated disks of the pillars prior to the removing thereof from the pillar.

Figure 3:
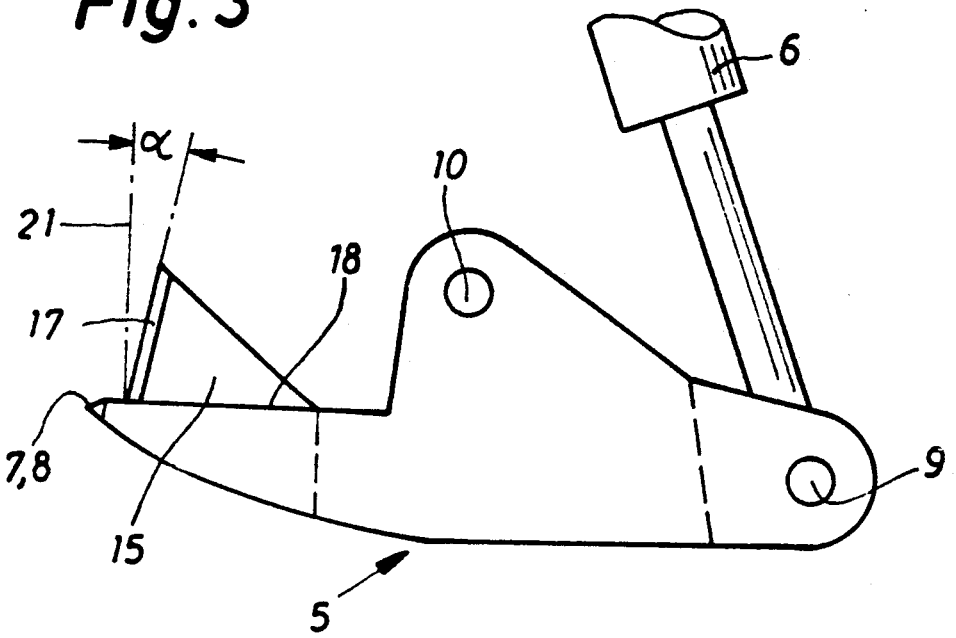
FIG. 3 illustrates a side view of a chisel having a crushing member.
Figure 4:
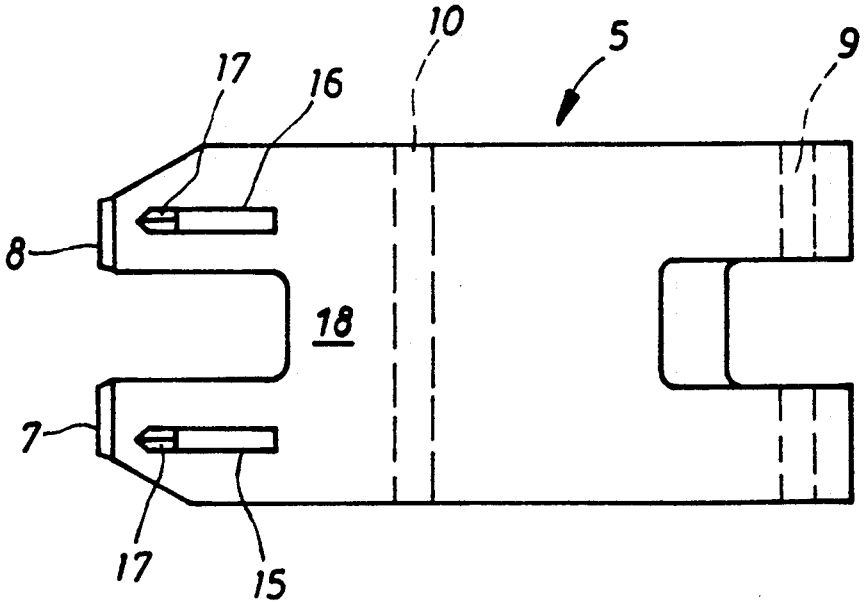
FIG. 4 is a top view of the chisel illustrated in FIG. 3.

FIGS. 3 and 4 illustrate now on a somewhat enlarged scale a chisel-shaped crushing tool 5 which is provided with crushing members 15, 16. These crushing members 15, 16 are plates located at the top surface of the crushing tool 5 and projecting away from this top surface and having each a cutting edge 17. This cutting edge 17 extends parallel to the plane defined by the plate 15 or 16, respectively. The plates are located somewhat set back from the cutting edges 7, 8. These further cutting edges 17 extend obliquely relative to the top surface 18 of the crushing tool 5 and accordingly also obliquely relative to the vertical line 21. The angle $\alpha$ defined thereby lies in the range of 0° to 30°. The vertical line 21 is a line which extends rectangularly to the top surface 18 of the chisel.

In operation, when the crushing tools 5 penetrate into the pillar 2 to be removed, a disk-shaped section of the pillar 2 is initially separated from the rest of the pillar by the forces exerted by the cutting edges 7, 8, which as can be easily understood, generate a roughly horizontally extending rupture area. Now, as soon as the cutting edges 7, 8 have penetrated into the concrete pillar over a distance corresponding to the set-back distance of the crushing members 15, 16, i.e. their distance from the cutting edges 7, 8, the further cutting edges 17 will begin to act onto the disk of the pillar to be separated. These cutting edges 17 which cause pressure forces to act from all sides onto the disk of the pillar cause the disk which is under process of getting removed from the rest of the pillar due to the influence of the cutting edges 7, 8 to be crushed such that this crushed disk of the pillar can be pulled off of the reinforcing bars 1 by exerting a small force only.

FIG. 3 discloses that this further cutting edge 17 extends obliquely relative to the top surface 18 of the crushing tool 5. FIG. 1 illustrates the two end positions of the crushing tool 5, and it is obvious that when the chisel-shaped crushing tool 5 begins to pivot against the pillar 2 its cutting edges 17 of the crushing members 15, 16 come to abut onto the section of the pillar to be worked upon at a continuously changing angle. Now quite obviously, force vectors must be present in the part of the disk of the pillar to be crushed and generated by the pressure of the crushing members 15, 16 acting thereagainst, which will actually cause a crushing of the disk of the pillar. It has now been found that the best result in this respect is achieved when the further cutting edge 17 is located obliquely relative to the vertical line 21 within an angle in the area of 0° to 30°. This causes an angle in the area of 90° to 60° relative to the top surface 18. In case the angle $\alpha$ would be selected at a higher value, i.e. the further cutting edge 17 would accordingly incorporate a relatively shallow inclination relative to the surface 18, the vertically acting force vectors generated in the section of the pillar to be separated would become too large such that the disk of the pillar would merely be lifted but not be crushed.

While there are shown and described present preferred embodiments of the invention, it is to be distinctly understood that the invention is not limited thereto, but may be otherwise variously embodied and practiced within the scope of the following claims.

I claim:

1. Apparatus for crushing a vertical reinforced concrete pillar to expose reinforcing bars contained therein, comprising:

(a) a horizontally arranged tubular frame (3) containing a central through passage for receiving the pillar in generally centered relation therein, said through passage having a vertical longitudinal axis (11);

(b) a plurality of crushing tool means connected with said frame in circumferentially spaced relation about said central through passage, each of said crushing tool means including:

(1) a chisel (5) pivotally connected intermediate its ends with said frame for pivotal movement about a horizontal pivot axis (14) normal to a vertical plane which contains said through passage longitudinal axis (11) and which bisects said pivot axis, said chisel having first and second arm portions on opposite sides of said pivot axis, said first arm portion being forked at its free end, thereby defining a pair of tine portions each having a first cutting edge (7,8) for engaging the pillar, said first cutting edges extending generally parallel with the pivot axis of said chisel;

(2) said chisel also including on each tine portion thereof a generally plate-shaped crushing member (15 spaced from an associated first cutting edge, said crushing member extending normal to said tine portion and generally normal to its associated first cutting edge, said crushing member including adjacent said first cutting edge a second cutting edge (17) inclined at an acute angle ($\alpha$) relative to a line normal to its associated tine portion; and (3) a plurality of piston and cylinder motor means (6) each pivotally connected at its ends between said frame and the free end of said second arm portion of the associated chisel for pivoting said chisels in opposite directions between crushing and disengaged positions relative to said frame, respectively, said pillar normally being centered relative to said frame when said chisels are initially pivoted in a crushing direction toward positions in which their cutting edges are in engagement with said pillar; and (c) flow control means (22) for controlling the flow of pressure fluid to said piston and cylinder motor means in such a manner that strokes of said pistons cause the chisels to maintain the pillar in centered relation relative to said frame during pivotal movement of said chisels in the crushing direction.

2. The apparatus of claim 1, wherein each of said piston-cylinder motor means extends obliquely relative to the longitudinal center axis of said frame.

3. The apparatus of claim 1, wherein the through passage of said frame has a square cross section, and further wherein said chisels and the piston and cylinder motor means associated therewith are arranged at every side of said frame.

4. The apparatus of claim 1, wherein the pivot axis (14) at which each of said chisels is connected with said frame is located at a higher elevation than said first cutting edge when said chisel is pivoted in the crushing direction into engagement with said pillar.

5. The apparatus of claim 1, wherein the second arm portion (19) of said chisel which is pivotably connected with the corresponding piston-cylinder motor means is longer than the first arm portion (20) carrying said first cutting edge.

6. The apparatus of claim 1, wherein the pivotal connection (13) between each piston-cylinder unit and said frame is located at a higher elevation than the pivot axis 14 of said chisel.

* * * * *